US011541658B2

(12) United States Patent
Anderson et al.

(10) Patent No.: US 11,541,658 B2
(45) Date of Patent: Jan. 3, 2023

(54) FLUIDIC DIE WITH NOZZLE LAYER ELECTRODE FOR FLUID CONTROL

(71) Applicant: Hewlett-Packard Development Company, L.P., Spring, TX (US)

(72) Inventors: Daryl E. Anderson, Corvallis, OR (US); Eric Martin, Corvallis, OR (US); James R. Przybyla, Corvallis, OR (US); Chien-Hua Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/251,982

(22) PCT Filed: Jan. 31, 2019

(86) PCT No.: PCT/US2019/016093

§ 371 (c)(1),
(2) Date: Dec. 14, 2020

(87) PCT Pub. No.: WO2020/159518

PCT Pub. Date: Aug. 6, 2020

(65) Prior Publication Data

US 2021/0347171 A1 Nov. 11, 2021

(51) Int. Cl.

| | |
|---|---|
| ***B41J 2/14*** | (2006.01) |
| ***B41J 2/085*** | (2006.01) |
| ***B41J 2/09*** | (2006.01) |

(52) U.S. Cl.

CPC ..... *B41J 2/14129* (2013.01); *B41J 2/085* (2013.01); *B41J 2/09* (2013.01); *B41J 2/1404* (2013.01); *B41J 2/14072* (2013.01); *B41J 2002/14169* (2013.01); *B41J 2202/04* (2013.01); *B41J 2202/18* (2013.01)

(58) Field of Classification Search

CPC . B41J 2/14129; B41J 2/085; B41J 2/09; B41J 2/14072; B41J 2/1404; B41J 2002/14169; B41J 2202/04; B41J 2202/18

See application file for complete search history.

(56) References Cited

U.S. PATENT DOCUMENTS

| | | | |
|---|---|---|---|
| 6,800,202 | B2 | 10/2004 | Moon et al. |
| 7,588,320 | B2 | 9/2009 | Lee et al. |
| 8,162,450 | B2 | 4/2012 | Barbet |
| 8,585,189 | B1 | 11/2013 | Marcus et al. |

(Continued)

FOREIGN PATENT DOCUMENTS

| | | |
|---|---|---|
| WO | WO-2005021273 | 3/2005 |

*Primary Examiner* — Yaovi M Ameh
(74) *Attorney, Agent, or Firm* — Foley & Lardner LLP

(57) ABSTRACT

One example provides a fluidic die including a semiconductor substrate, and a nozzle layer disposed on the substrate, the nozzle layer having a top surface opposite the substrate and including a nozzle formed therein, the nozzle including a fluid chamber disposed below the top surface and a nozzle orifice extending through the nozzle layer from the top surface to the fluid chamber, the fluid chamber to hold fluid, and the nozzle to eject fluid drops from the fluid chamber via the nozzle orifice. An electrode is disposed in contact with the nozzle layer about a perimeter of the nozzle orifice, the electrode to carry an electrical charge to adjust movement of electrically charged components of the fluid.

9 Claims, 6 Drawing Sheets

(56) References Cited

U.S. PATENT DOCUMENTS

| | | | | |
|---|---|---|---|---|
| 2001/0001455 | A1* | 5/2001 | Moon | H01J 49/167<br>436/171 |
| 2005/0219323 | A1* | 10/2005 | Kusakari | B41J 2/14233<br>347/42 |
| 2007/0126799 | A1* | 6/2007 | Steiner | B41J 2/115<br>347/82 |
| 2007/0211105 | A1 | 9/2007 | Furukawa | |
| 2008/0088655 | A1 | 4/2008 | Oki et al. | |
| 2012/0105528 | A1 | 5/2012 | Alleyne et al. | |

* cited by examiner

FLUIDIC DIE WITH NOZZLE LAYER ELECTRODE FOR FLUID CONTROL

BACKGROUND

Fluidic devices, such as fluidic dies, for example, include a nozzle layer (e.g., an SU8 layer) disposed on a substrate (e.g., silicon). In some cases, the nozzle layer comprises multiple layers such as a chamber layer disposed on the substrate and an orifice layer disposed on the chamber layer. A plurality of nozzles are formed in the nozzle layer. In some examples, each nozzle includes a fluid chamber formed within the chamber layer and a nozzle orifice extending through the orifice layer from an upper surface opposite the substrate to the fluid chamber, and through which fluid drops may be ejected from the fluid chamber. Some example fluid devices may be printheads, where a fluid within the fluid chambers may be ink.

Figure 1:
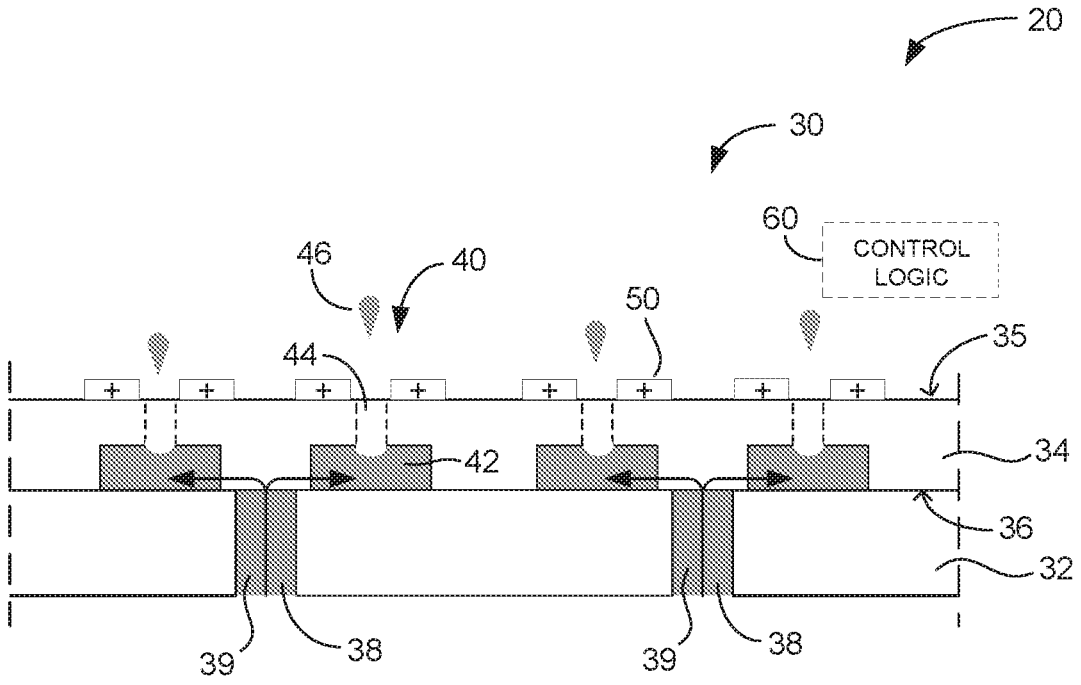
FIG. 1 is a cross-sectional view generally illustrating a fluidic die, according to one example.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Examples of fluidic devices, such as fluidic dies, for instance, may include fluid actuators. Fluid actuators may include thermal resistor based actuators, piezoelectric membrane based actuators, electrostatic membrane actuators, mechanical/impact driven membrane actuators, magnetostrictive drive actuators, or other suitable devices that may cause displacement of fluid in response to electrical actuation. Example fluidic dies described herein may include a plurality of fluid actuators, which may be referred to as an array of fluid actuators. An actuation event or firing event, as used herein, may refer to singular or concurrent actuation of fluid actuators of a fluidic die to cause fluid displacement.

Example fluidic dies may include fluid channels, fluid chambers, orifices, and/or other features which may be defined by surfaces fabricated in a substrate and other material layers of the fluidic die such as by etching, microfabrication (e.g., photolithography), micromachining processes, or other suitable processes or combinations thereof. Some example substrates may include silicon based substrates, glass based substrates, gallium arsenide based substrates, and/or other such suitable types of substrates for microfabricated devices and structures.

As used herein, fluid chambers may include ejection chambers in fluidic communication with nozzle orifices from which fluid may be ejected, and fluidic channels through which fluid may be conveyed. In some examples, fluidic channels may be microfluidic channels where, as used herein, a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.).

In some examples, a fluid actuator may be arranged as part of a nozzle where, in addition to the fluid actuator, the nozzle includes a fluid chamber in fluidic communication with a nozzle orifice. The fluid actuator is positioned relative to the fluid chamber such that actuation of the fluid actuator causes displacement of fluid within the fluid chamber that may cause ejection of a fluid drop from the fluid chamber via the nozzle orifice. Accordingly, a fluid actuator arranged as part of a nozzle may sometimes be referred to as a fluid ejector or an ejecting actuator.

In one example nozzle, the fluid actuator comprises a thermal actuator, where actuation of the fluid actuator (sometimes referred to as "firing") heats fluid within the fluid chamber to form a gaseous drive bubble therein, where such drive bubble may cause ejection of a fluid drop from the fluid chamber via the nozzle orifice (after which the drive bubble collapses). In one example, the thermal actuator is spaced from the fluid chamber by an insulating layer. In one example, a cavitation plate may be disposed within the fluid chamber (e.g., at a bottom of the fluid chamber), where the cavitation plate is positioned to protect material underlying the fluid chamber, including the underlying insulating material and fluid actuator, from cavitation forces resulting from generation and collapse of the drive bubble. In examples, the cavitation plate may be metal (e.g., tantalum). In some examples, the cavitation plate may be in contact with the fluid within the fluid chamber.

In some examples, a fluid actuator may be arranged as part of a pump where, in addition to the fluidic actuator, the pump includes a fluidic channel. The fluidic actuator is positioned relative to the fluidic channel such that actuation of the fluid actuator causes fluid displacement in the fluid channel (e.g., a microfluidic channel) to convey fluid within the fluidic die, such as between a fluid supply and a nozzle, for instance. A fluid actuator arranged to convey fluid within a fluidic channel may sometimes be referred to as a non-ejecting actuator or fluid pump. In some examples, similar to that described above with respect to a nozzle, a metal cavitation plate may be disposed within the fluidic channel above the fluid actuator to protect the fluidic actuator and underlying materials from cavitation forces resulting from generation and collapse of drive bubbles within the fluidic channel.

Fluidic dies may include an array of fluid actuators (such as a column or columns of fluid actuators), where the fluid actuators of the array may be arranged as fluid ejectors (i.e., having corresponding fluid ejection chambers with nozzle orifices) and/or fluid pumps (having corresponding fluid channels), with selective operation of fluid ejectors causing fluid drop ejection and selective operation of fluid pumps causing fluid displacement within the fluidic die. In some examples, the array of fluid actuators may be arranged into primitives.

Fluidic dies may include a nozzle layer (e.g., an SU8 photoresist layer) disposed on a substrate (e.g., a silicon substrate) with the fluid chamber and nozzle orifice of each nozzle being formed in the nozzle layer. In one example, the SU8 layer has first surface (e.g., a lower surface) disposed on the substrate (facing the substrate), a second surface (e.g., an upper surface) opposite the first surface (facing away from the substrate). In one example, each fluid chamber has a corresponding nozzle orifice extending through the nozzle layer from the upper surface to the fluid chamber, where fluid drops (e.g., ink drops) may be ejected from the fluid chamber via the nozzle orifice.

In some cases, during operation of the fluidic die, characteristics of a fluid being ejected by the fluidic die may adversely impact the quality of fluid drops ejected by the nozzles. For example, in some cases, due to adhesion forces between fluid molecules and/or between fluid molecules and sidewalls of a nozzle orifice, when being ejected from a nozzle orifice, fluid drops may not separate cleanly from fluid remaining in the nozzle such that trailing portions of the fluid drop may separate from the fluid drop to form what are sometimes referred to as satellite drops. Satellite drops may deviate from a path of the fluid drop and produce undesirable output artifacts (e.g., artifacts in a printed image).

In other cases, ingredients or components of a fluid mixture (sometimes simply referred to herein as a fluid) may become separated such that the fluid does not have a uniform consistency. For example, in a case where the fluid is ink, if a nozzle has been idle for a period of time, pigments within the ink mixture may settle toward a bottom the fluid chamber. As a result, ejected ink drops may not have a desired color or be inconsistent in color between drops.

According to examples of the present disclosure, electrodes are disposed in contact with the nozzle layer about a perimeter of, but spaced from, each nozzle orifice (e.g., disposed on the upper surface or embedded within the nozzle layer), where, for each nozzle, the electrode is to carry an electrical charge to adjust movement of electrically charged components of fluid ejected from the corresponding fluid chamber nozzle orifice to improve the quality of the fluidic output.

FIG. 1 is a cross-sectional view generally illustrating portions of a fluidic device 20, such as a fluidic die 30, including electrodes (e.g., conductive traces) disposed about perimeters of nozzle orifices in a nozzle layer to adjust movement of fluid, in accordance with one example of the present disclosure.

According to one example, fluidic die 30 includes a substrate 32, such as a silicon substrate, with a nozzle layer 34 disposed thereon. In one example, nozzle layer 34 has a lower surface 36 (e.g., a first surface) disposed on substrate 32, and an opposing upper surface 35 (e.g., a second surface). In one example, nozzle layer 34 comprises an SU-8 material.

Nozzle layer 34 includes a plurality of nozzles formed therein, such as illustrated by nozzle 40, with each nozzle 40 including a fluid chamber 42 disposed within nozzle layer 34, and a nozzle orifice 44 extending through the nozzle layer 34 from upper surface 35 to fluid chamber 42. In one example, substrate 32 includes a plurality of fluid feed holes 38 to supply fluid 39 (e.g., ink) from a fluid source to fluid chambers 42 of nozzles 40 (as illustrated by the arrows in FIG. 1). In other examples, nozzles 40 may receive fluid from a fluid slot. In operation, nozzles 40 are selectively controlled to eject fluid drops 46 from fluid chamber 42 via nozzle orifices 44 (see FIGS. 2A-2D below).

As described above, during operation, characteristics of fluid 39 being ejected by fluidic die 30 (e.g., adhesion forces between molecules of fluid 39 and/or adhesion forces between fluid molecules and surfaces of nozzle orifices 44, such as sidewalls 45 of nozzle orifices 44) may adversely impact the quality of fluid drops ejected from nozzles 40. In one example, fluidic die 30 includes an electrode or conductive trace 50 disposed about a perimeter of each nozzle orifice 44. In one case, as illustrated, conductive trace 50 is disposed on upper surface 35 of nozzle layer 34. In other examples, conductive trace 50 may be fully or partially embedded within nozzle layer 34. In one example, conductive trace 50 may be a continuous trace disposed concentrically about a corresponding nozzle orifice 44 (e.g., see FIG. 3*e*). In other examples, conductive trace 50 may comprise multiple conductive traces disposed radially about a perimeter of a corresponding nozzle orifice 44. It is noted that any number of configurations for placement of conductive trace 50 about nozzle orifice 44 may be employed. Conductive trace 50 may be made of any suitable conductive material, including Al, Cr/Au, Ta, Ti, and doped polysilicon, for example.

In one example, as will be described in greater detail below (e.g., FIGS. 3*a*-3*d*), as a fluid drop 46 is being ejected from nozzle orifice 44 of a given nozzle 40, the corresponding conductive trace 50 is electrically charged with a polarity the same as an electrical polarity of fluid 39 (or a component of fluid 39), such as a positive charge (e.g., a positive charge "+" as illustrated in FIG. 1), to truncate fluid drop 46 to eliminate the occurrence of satellite drops. In another example, as will be described in greater detail below (e.g., see FIGS. 4*a*-4*c*, conductive trace 50 is electrically charged to adjust positions of charged pigment particles within fluid 39 so that such pigment particles are more evenly dispersed within the corresponding fluid chamber 42. It is noted that charges on conductive traces 50 may control movement of fluid 39 within nozzles 40 for any number of purposes in addition to examples described herein.

In one example, control logic 60 may be electrically connected to conductive trace 50 to control charges (e.g., polarity and timing) on conductive traces 50. In one example, control logic 60 may be external to fluidic die 30 (e.g., as part of a printer controller), as indicated by the dashed lines in FIG. 1. In other cases, control logic 60 may be integrated within fluidic die 30, such as an integrated circuit within substrate 32, for example (e.g., see FIGS. 3*a*-3*d*).

According to examples described herein, by adjusting movement of fluid 38 via placement of charges on conductive traces 50 disposed in nozzle layer 34, a quality of fluid ejection by fluid die 30 is improved.

FIGS. 2A-2D are cross-sectional views generally illustrating a nozzle 40, according to one example, and generally illustrating ejection of a fluid drop 46 therefrom. In the examples of FIGS. 2A-2D, nozzle 40 includes a thermal actuator 70, such as a thermal resistor, for example, to vaporize a portion of fluid 39 to form a drive bubble 80 within fluid chamber 42 to eject a drop 46 during a firing event. In the illustrated example, nozzle 40 further includes a cavitation plate 72 disposed on a bottom surface of fluid chamber 42 so as to be positioned above thermal actuator 70. As mentioned above, cavitation plate 72 protects thermal actuator 70 and material underlying fluid chamber 42 from cavitation forces created by drive bubble collapse.

Figure 2A:
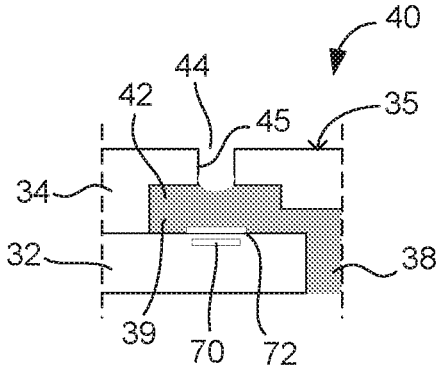
FIGS. 2A-2D generally illustrate ejection of a fluid drop from a fluidic die, according to one example.
Figure 2B:
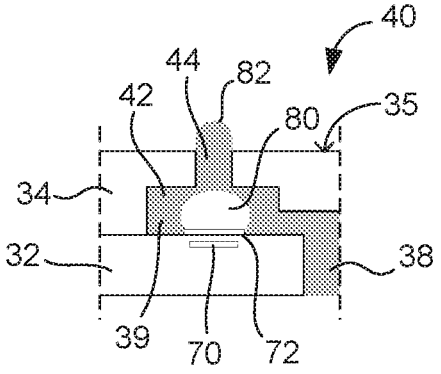

With reference to FIG. 2A, prior to an actuation event, when thermal actuator 70 is not energized, fluid chamber 42 is filled with fluid 39, such as ink for example. Upon initiation of an actuation event, as illustrated by FIG. 2B, thermal actuator 70 is energized and begins heating fluid 39, causing vaporization of at least a portion of a component of fluid 39 (e.g., water) to begin formation of drive bubble 80 within fluid chamber 42, where the expanding drive bubble 80 begins to force a portion 82 of fluid 39 from fluid chamber 42 via nozzle orifice 44.

Figure 2C:
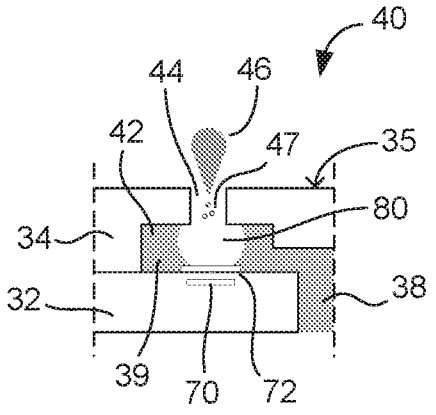
Figure 2D:
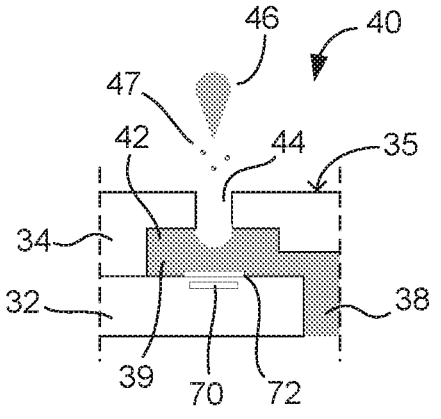

With reference to FIG. 2C, as thermal actuator 70 continues to heat fluid 39, drive bubble 80 continues to expand until it escapes from nozzle orifice 44 and expels portion 82 of fluid 39 therefrom in the form a fluid drop 46. With reference to FIG. 2D, upon ejection of fluid drop 46, thermal actuator is de-energized and drive bubble 80 collapses as fluid drop 46 continues to move away from nozzle orifice 44. Upon completion of the firing event, nozzle 40 returns to a state as illustrated by FIG. 2A.

As described above, and as illustrated by FIGS. 2C-2D, due to adhesion forces between fluid molecules and between the fluid and sidewalls 45 of nozzle orifice 44 (as well as other factors), fluid drops 46 may become elongated as they are ejected from nozzle orifice 44 such that portions of fluid may separate from drop 46 to form satellite drop(s) 47. Satellite drops 47 may deviate from drop 46 and form artifacts in an article formed by fluid drops 46 (such as a printed image, for example).

FIGS. 3*a*-3*d* are cross-sectional views generally illustrating portions of fluidic die 30, including an example nozzle 40, and generally demonstrate controlling movement of electrically charged fluid 39 by employing conductive trace 50 disposed about nozzle orifice 44 to apply an electrical charge to "break off" a fluid drop to set a drop size and/or to eliminate satellite drops, in accordance with one example of the present application.

Figure 3A:
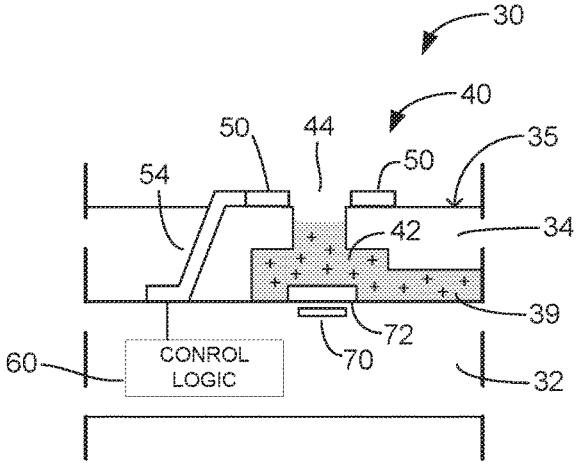
FIGS. 3A-3E generally illustrate a fluidic die and a method of operating a fluidic to adjust fluid movement, according to one example.

Similar to that illustrated by FIGS. 2*a*-2*d*, nozzle 40 includes a fluid actuator 70 (in the form a thermal resistor) disposed below fluid chamber 42, with a cavitation plate 72 disposed between fluid chamber 42 and fluid actuator 70. According to the illustrated example, control logic 60 is integrated within substrate 32. Conductive trace 50 is disposed about a perimeter of nozzle 44 and is coupled to control logic 60 by via 54 extending through nozzle layer 34. In one example, control logic 60, fluid actuator 70 are formed within an integrated circuit layer and thin film layer, including structured metal layers, disposed along an upper surface of substrate 32 below nozzle layer 34. Although not illustrated, it is noted that control logic 60 is connected to external devices, such as a printer controller, for example. In one example, as illustrated by FIG. 3*e*, which represents a top view of fluidic die 30 of FIGS. 3*a*-3*d*, conductive trace 50 is continuously disposed in a concentric fashion about the perimeter of nozzle orifice 44 and connected to control logic 60 through via 54.

According to one example, in operation, fluid 39 received by nozzle 40 has an electrical charge having a known polarity (e.g., a positive "+" or negative "−" polarity). Fluid 39 may be electrically charged using any suitable means (not illustrated herein), including via fluid supply system external to fluidic die 30, for example. For illustrative purposes, according to the example of FIGS. 3*a*-3*e*, fluid 39 has an electrical charge having a positive polarity, as indicated by the "+" sign. Initially, according to one example, conductive trace 50 does not carry a charge (i.e., is neutral).

Figure 3B:
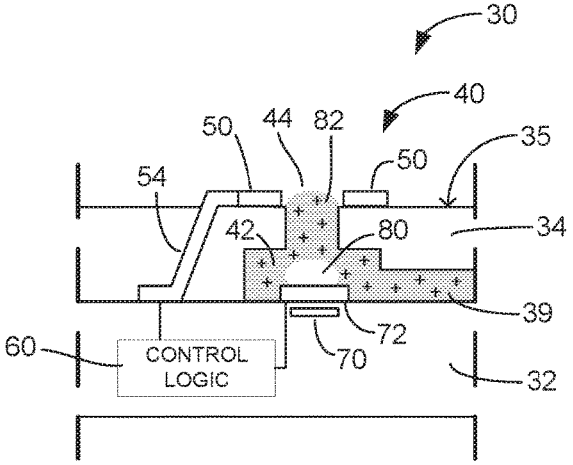
Figure 3C:
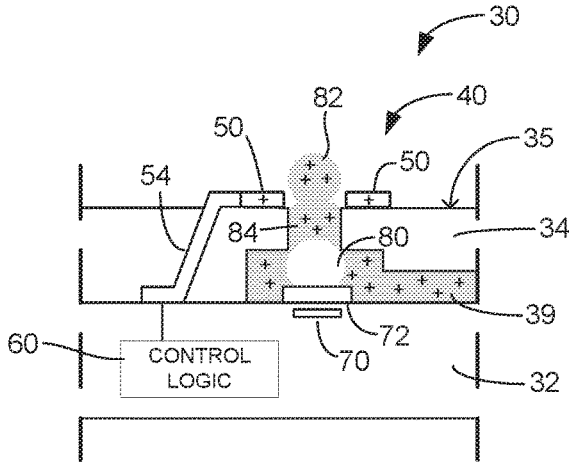

Referring to FIG. 3*b*, upon energization of fluid actuator 70, drive bubble 80 begins to form and begins to push fluid 39 into nozzle orifice 44. With reference to FIG. 3*c*, as drive bubble 80 continues to expand and forces fluid 39 through nozzle orifice 44, control logic 60 applies an electrical charge having a same polarity as that of fluid 39 to conductive trace 50 (which is a positive polarity in the illustrated example). As illustrated, the like charge between conductive trace 50 and fluid 39 creates a repulsive force which results in a "pinching" effect on fluid 39, with the fluid within the opening through conductive trace 50 being pushed inward toward a vertical axis of nozzle orifice 44.

Figure 3D:
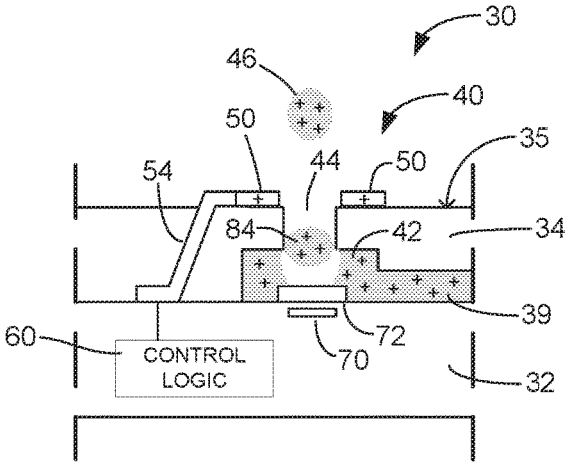
Figure 3E:
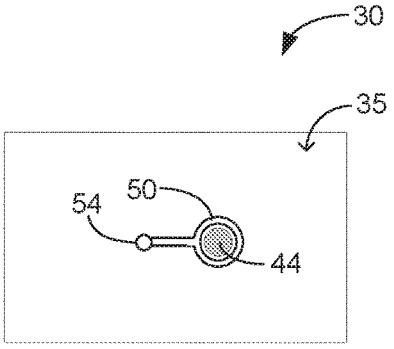

With reference to FIG. 3*d*, upon drive bubble 80 expanding and escaping through nozzle orifice 44, the portion of the fluid 82 that has passed through nozzle orifice 44 is pinched off from a portion of fluid 84 that has not passed through nozzle orifice 44 to form fluid drop 46, with the repulsive forces pushing fluid drop 46 away from fluidic die 30 and repelling the remaining fluid 84 back into fluid chamber 42.

By pinching or breaking off fluid 82 as it passes through nozzle orifice 44 to form fluid drop 46, the repulsive forces created by applying an electrical charge to conductive trace 50 with a polarity the same as that of the charged fluid more cleanly separates fluid drop 46 from fluid remaining in nozzle 40 and reduces the formation of satellite drops. Additionally, by controlling a timing of when the electrical charge is applied to conductive trace 50 during drop ejection, a size of fluid drop 46 may be selectively controlled.

Figure 4A:
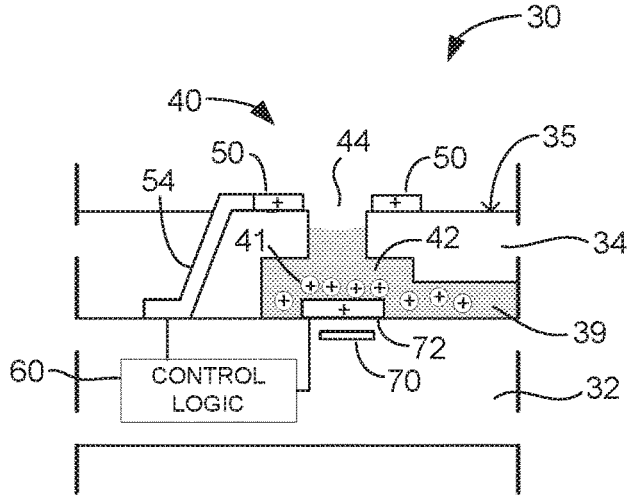
FIG. 4A-4C generally illustrate a fluidic die and a method of operating a fluidic to adjust fluid movement, according to one example.
Figure 4B:
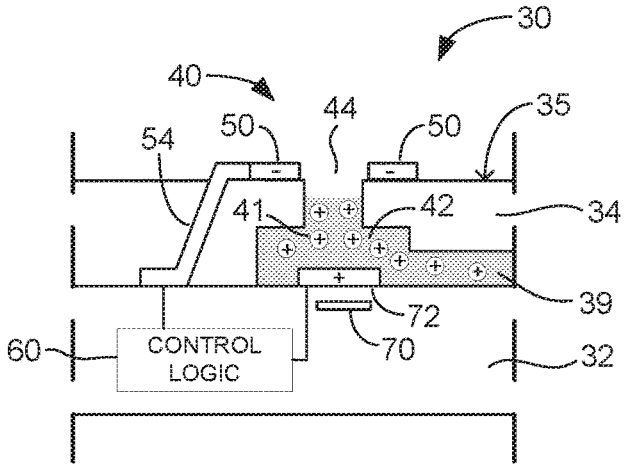
Figure 4C:
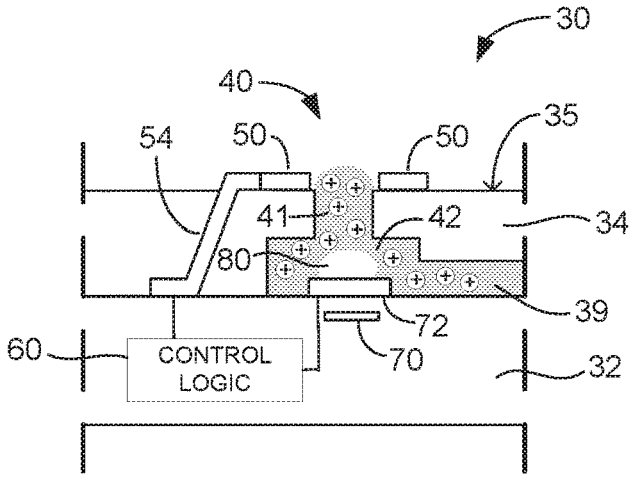

FIGS. 4*a*-4*c* are cross-sectional views generally illustrating portions of fluidic die 30, including an example nozzle 40, and generally demonstrate controlling movement of electrically charged fluid 39 by applying an electric charge to conductive trace 50 to control movement of particles within fluid 39 (such as pigment particles when fluid 39 comprises ink), in accordance with one example of the present application.

In one example, in addition to conductive trace 50, an additional conductive trace to which a charge may be applied by control logic 60 is disposed below fluid 39 within fluid chamber 42 to further influence movement of the particles within fluid 39. In one case, as illustrated, cavitation plate 72 serves as such additional conductive trace. In other examples, thermal resistor 70 may serve as such conductor, or a separate conductor may be employed. In one example, in addition to being electrically connected to conductive trace 50, control logic 60 is also electrically connected to cavitation plate 72.

With reference to FIG. 4*a*, in operation, according to one example, fluid 39 received by nozzle 40 is ink including a plurality of pigment particles 41 in a carrier fluid, the pigment particles 41 having an electrical charge with a known polarity (e.g., a positive "+" or a negative "−" polarity). For purposes of the example of FIGS. 4*a*-4*c*, pigment particles 41 are illustrated as having an electrical charge with a positive polarity (+). Initially, according to one scenario, control logic 60 applies an electrically charge to conductive trace 50 and cavitation plate 72 having a same polarity as the known polarity of pigment particles 41 so that pigment particles 41 are not affected by conductive trace 50 and cavitation plate 72. As illustrated by FIG. 3*a*, pigment particles 41 may settle to the bottom of fluid chamber 42, including onto cavitation plate 72, where the pigment particles 41 may cogate and adversely impact fluid drop ejection, such by reducing acceleration of fluid drops 46 from nozzle orifice 44, for instance (particularly if nozzle 40 is inactive for an extended period of time).

With reference to FIG. 4*b*, according to one example, at a given time before energization of fluid actuator 70 to begin formation of a drive bubble, control logic 60 provides a negative charge to conductive trace 50 (i.e., a charge opposite to that of pigment particles 41) and positive charge to cavitation plate 72 (i.e., the same charge as that of pigment particles 41) to form an electric field vertically across fluid 39 in fluid chamber 42. The positive charge on cavitation plate 72 repels pigment particles 41 away from the bottom of fluid chamber 42, while the negative charge on conductive trace 50 pulls pigment particles 41 upwardly toward nozzle orifice 44.

With reference to FIG. 4*c*, as drive bubble 80 continues to expand, the vertical field formed by the opposite polarity of charges on conductive trace 50 and cavitation plate 72 move pigment particles 41 away from cavitation plate 72 and more evenly distribution pigment particles 41 within fluid 39 so that fluid drops ejected from nozzle 40 are consistent in color. As such, according to the example implementation of nozzle 40 illustrated by FIGS. 4*a*-4*c*, application of an electrical charge to conductive trace 50 and/or to cavitation plate 72 (or another conductive element below fluid 39 in fluid chamber 42) mixes pigment particles 41 within a fluid carrier of ink 39 to prevent cogation of pigment particles 41 on cavitation plate 72 and to provide fluid 39, when fluid 39 comprises ink, with a more homogenous color consistency.

FIGS. 5*a*-5*d* are cross-sectional views generally illustrating portions of fluidic die 30, including an example nozzle 40, and generally demonstrate controlling movement of electrically charged fluid 39 by applying an electric charge to conductive trace 50 to transfer an electrical charge to a particle within fluid 39 so that movement of the charged particle can be directed by an electrical field after being ejected from nozzle 40, such as by a charged plate external to nozzle 40. In one example, the particles within fluid 39 may be of different types which accumulate different amounts of charge from conductive trace 50 such that the external electrical field deflects path of trajectory of the different types of particles by different amounts so that such particles can be sorted. In one example, as describe below, the particles within fluid 39 may comprise biologic particles, such as cells, for instance.

Figure 5A:
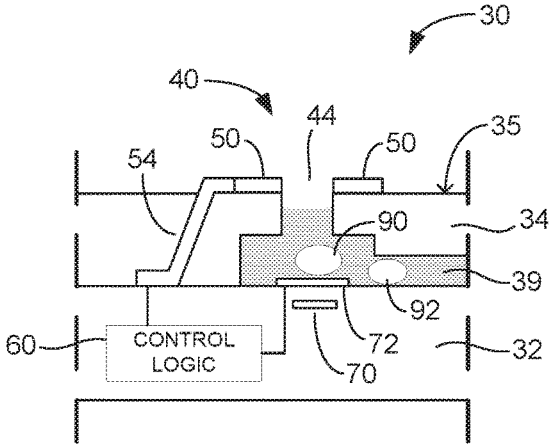
FIG. 5A-5D generally illustrate a fluidic die and a method of operating a fluidic to adjust fluid movement, according to one example.

With reference to FIG. 5*a*, in operation, according to the illustrated example, nozzle 40 receives fluid 39 including a plurality of biologic particles, as illustrated by cells 90 and 92, where cells 90 and 92 are of different types. It is noted that in other examples fluid 39 may include more than two different types of cells. Initially, as illustrated in FIG. 5*a*, control logic 60 applies no electrical charge to conductive trace 50.

Figure 5B:
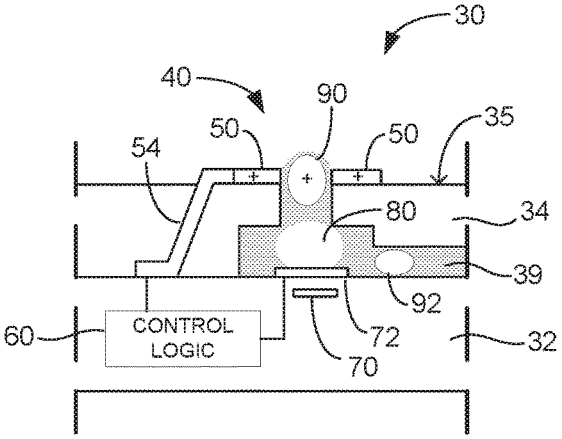

With reference to FIG. 5*b*, according to one example, at an appropriate time, such as upon initiation of an actuation event to eject a cell 90 or 92 from fluid chamber 42 via nozzle 44 (e.g., upon energization of fluid actuator 70), or instance, control logic 60 applies an electrical charge having a desired polarity to conductive trace 50. For purposes of illustration, in the example of FIGS. 5*a*-5*d*, an electrical charge having a positive polarity if applied to conductive trace 50. In contrast to the implementations of FIGS. 3*a*-3*d* and 4*a*-4*c*, where conductive trace 50 is spaced from the perimeter of nozzle orifice 44 so as to not contact fluid 39 as it is ejected from nozzle orifice 44, conductive trace 50 in the implementation of FIGS. 5*a*-5*d* is positioned to contact fluid 39 to contact fluid 39 as it is ejected from nozzle orifice 44. In FIG. 5*b*, as drive bubble 80 expands and pushes a cell 90 through nozzle orifice 44, the positive charge from conductive trace 50 is transferred to cell 90 through contract with fluid 39 surrounding cell 90.

Figure 5C:
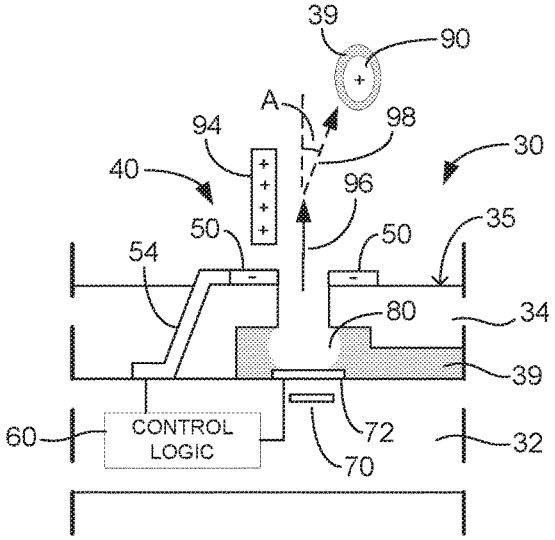

Referring to FIG. 5*c*, in one example, just prior to drive bubble 80 escaping from fluid chamber 42, control logic 60 flips the polarity on conductive trace 50 from a positive polarity to a negative polarity such that a repulsive force between negatively charged conductive trace 50 and positively charged cell 90 pushes cell 90 away from nozzle orifice 44 when drive bubble 80 ejects cell 90 from nozzle 40. In one example, a charged plate 94 is disposed external to nozzle orifice 44 along an initial ejection path 96 of cell 90, where the charge on plate 94 has a polarity the same as that of charged cell 90 (e.g., a positive polarity in the illustrated example). A repulsive force between the positive charge on plate 94 and the positive charge of cell 90 deflects cell 90 along a deflected ejection path 98, where deflected ejection path 98 is at a deflection angle A from initial ejection path 96, where the magnitude of angle A depends on an amount of charge on cell 90 (the greater the charge the greater the deflection angle).

Figure 5D:
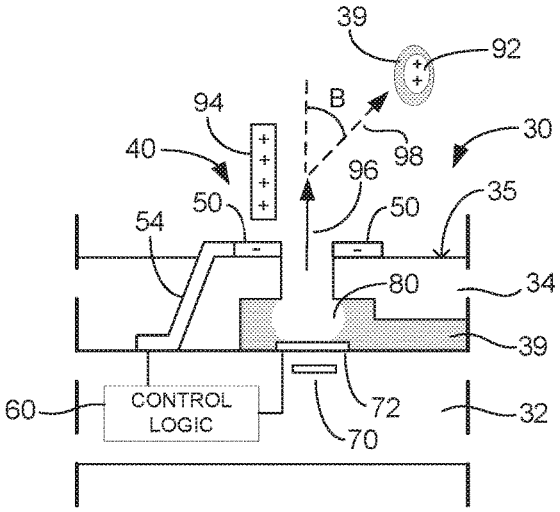

For example, with reference to FIG. 5*d*, cell 92 is of a type that is capable of acquiring and carrying a greater charge than the type of cell represented by cell 90. As such, the deflection angle B of cell 92 is greater than that deflection angle A associated with cell 90. It is known that different types of cells, or other types of biologic materials (e.g., protein), have different charge carrying capabilities. As such, the implementation of FIGS. 5*a*-5*d* may be employed to sort cells 90 and 92 from fluid 39 based on the differing amounts of deflection from charged plate 94.

It is noted that objects other than biologic materials may be sorted from one another, so long as such objects have different charge carrying characteristics. Furthermore, it is noted that external plate 94 and cells 90 and 92 (or other objects or particles) may be charged with opposite polarities so as to deflect the cells toward plate 94, so long as such deflection does not result in the cells contacting plate 94.

Figure 6:
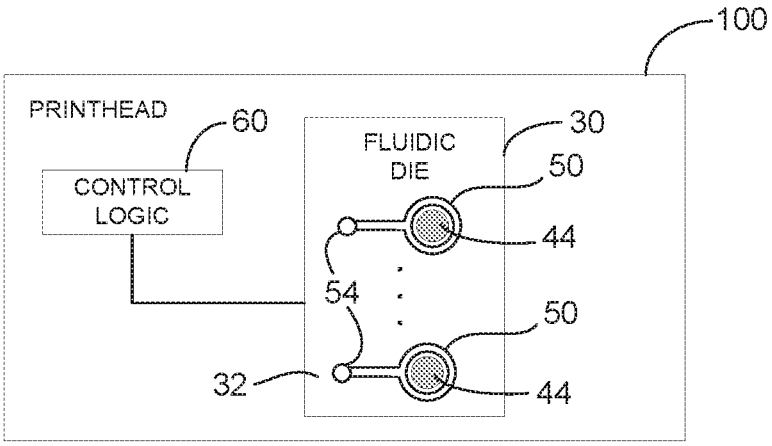
FIG. 6 is a block and schematic diagram generally illustrating a printhead including a fluidic die, according to one example.

FIG. 6 is a block and schematic diagram generally illustrating a printhead 100 including a fluidic die 30 having a plurality of conductive traces 50 disposed on top surface 35 of nozzle layer 32 concentrically about nozzle orifices 44, and further including control logic 60 disposed external to fluidic die 30, according to one example of the present disclosure. In other examples, control logic 60 may be integrated within fluidic die 30. In other examples, printhead 100 may include multiple fluidic die 30, with externally disposed monitoring circuitry 60 to apply electrical charges to conductive traces 50 of each of the fluidic die 30 to modify the movement of fluid, such as described by the examples above. In other examples, printhead 100 may be part of a printer.

Figure 7:
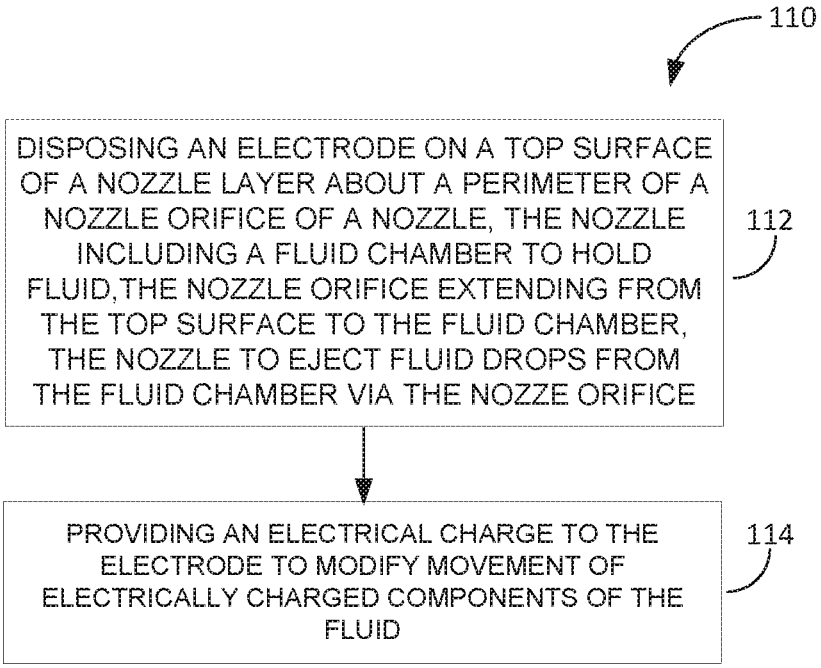
FIG. 7 is a flow diagram generally illustrating a method of operating a fluidic die, according to one example.

FIG. 7 is a flow diagram generally illustrating an example of a method 110 of monitoring surface conditions of a fluidic die, such as fluidic die 30 of FIGS. 1 and 3, for instance. At 112, method 110 includes disposing an electrode about a perimeter of a nozzle orifice of a nozzle, the nozzle including a fluid chamber to hold fluid, the nozzle orifice extending from the top surface to the fluid chamber, the nozzle to eject fluid drops from the fluid chamber via the nozzle orifice, such as electrode 50 being concentrically disposed about nozzle orifice 44 of fluid chamber 42 of nozzle 40 from which fluid drops 46 are ejected, as illustrated by FIGS. 1-5. At 114, method 110 includes providing an electric charge to the electrode to modify movement of electrically charged components of the fluid, such as electrode 50 having an electrical charge with a polarity either the same as or different from a polarity of electrically charged components of fluid 39 of FIGS. 3-5, such as fluid molecules of fluid 39 (FIG. 3), particles within fluid 39, such as pigment particles 41 (FIG. 4), and biologic particles 90, 92 (FIG. 5).

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluidic die comprising:

a semiconductor substrate;

a nozzle layer disposed on the substrate, the nozzle layer having a top surface opposite the substrate and including a nozzle formed therein, the nozzle including a fluid chamber disposed below the top surface and a nozzle orifice extending through the nozzle layer from the top surface to the fluid chamber, the fluid chamber to hold fluid having an electrical charge of a known polarity, the nozzle to eject individual fluid drops from the fluid chamber at the nozzle orifice; and an electrode disposed in contact with the nozzle layer about a perimeter of the nozzle orifice, the electrode to carry an electrical charge to adjust movement of components of the fluid having the electrical charge of the known polarity, the fluid having an electrical charge of first polarity, as fluid is being ejected from the nozzle orifice such that a portion of fluid is extending from the nozzle orifice beyond the top surface of the nozzle layer, the electrode to transition from having a neutral charge to having a charge of the first polarity to create a repulsive force between the electrode and the fluid that forces fluid proximate to the electrode toward a longitudinal axis of the nozzle orifice such that the portion of fluid extending of the above the top surface is separated from a portion of fluid remaining in the nozzle orifice to form an ejected fluid drop and the portion of fluid remaining in the nozzle orifice forced downward by the repulsive force toward the fluid chamber.

2. A fluidic die comprising:

a semiconductor substrate;

a nozzle layer disposed on the substrate, the nozzle layer having a top surface opposite the substrate and including a nozzle formed therein, the nozzle including a fluid chamber disposed below the top surface and a nozzle orifice extending through the nozzle layer from the top surface to the fluid chamber, the fluid chamber to hold fluid having an electrical charge of a known polarity, the nozzle to eject fluid drops from the fluid chamber via the nozzle orifice; and an electrode disposed in contact with the nozzle layer about a perimeter of the nozzle orifice, the electrode to carry an electrical charge to adjust movement of components of the fluid having the electrical charge of the known polarity, the nozzle including a conductive element at a bottom of the fluid chamber, the fluid including particles having an electrical charge of a first polarity, prior to fluid being ejected from the nozzle, the conductive element to carry an electrical charge having the first polarity and the electrode to carry an electrical charge having a second polarity opposite the first polarity to form an electrical field across the fluid from the substrate to the top surface so as to more even distribute the particles within the fluid by moving them away from the bottom of the fluid chamber toward the nozzle orifice.

3. The fluidic die of claim 2, the fluid comprising ink, the particles comprising pigment particles.

4. A fluidic die comprising:

a semiconductor substrate;

a nozzle layer disposed on the substrate, the nozzle layer having a top surface opposite the substrate and including a nozzle formed therein, the nozzle including a fluid chamber disposed below the top surface and a nozzle orifice extending through the nozzle layer from the top surface to the fluid chamber, the fluid chamber to hold fluid, the nozzle to eject fluid drops from the fluid chamber via the nozzle orifice;

an electrode disposed in contact with the nozzle layer about a perimeter of the nozzle orifice, the electrode to carry an electrical charge to adjust movement of electrically charged components of the fluid; and a deflector plate electrically charged with a first polarity positioned above the top surface of the nozzle layer adjacent to the nozzle orifice;

the electrode disposed concentrically about a perimeter edge of the nozzle orifice so as to contact fluid when exiting the nozzle orifice, the fluid including different types of biologic tissue particles, each type capable of accumulating differing levels of electric charge;

the electrode to carry an electrical charge having the first polarity as a fluid drop containing a biologic particle passes through the nozzle orifice, where contact with the electrode charges the biologic tissue particle with an electric charge of the first polarity such that after ejection from the nozzle orifice, a repulsive force between the biologic tissue particle and the deflector plate deflects a trajectory path of the biologic tissue particle by an amount based on a level of accumulated electric charge on the biologic tissue particle.

5. The fluidic die of claim 4, each biologic tissue particle comprising a biologic cell.

6. A method of operating a fluidic die comprising:

disposing an electrode on a top surface of a nozzle layer about and set back from a perimeter of a nozzle orifice of a nozzle, the nozzle including a fluid chamber to hold fluid having an electrical charge of first polarity, the nozzle orifice extending from the top surface to the fluid chamber, the nozzle to eject individual fluid drops having an electrical charge of a known polarity from the fluid chamber at the nozzle orifice, the electrode being disposed concentrically about and set back from a perimeter of the nozzle orifice so as to not directly contact fluid ejected from the nozzle orifice;

providing an electric charge to the electrode to modify movement of electrically charged components of the fluid drop having the electrical charge of the known polarity;

initiating ejection of a fluid drop from the nozzle orifice; and applying an electrical charge of the first polarity to the electrode when a first portion of fluid being ejected from the nozzle orifice is extending beyond the top surface of the nozzle layer to create a repulsive force between the electrode that fluid that forces fluid toward a center of the nozzle orifice such that the first portion of fluid is separated from a second portion of fluid remaining in the nozzle orifice to form an ejected drop and the second portion is forced toward the fluid chamber.

7. The method of claim 6, including:

maintaining a neutral charge on the electrode until the first portion of fluid extends beyond the top surface of the nozzle layer.

8. A method of operating a fluidic die comprising:

disposing an electrode on a top surface of a nozzle layer about and set back from a perimeter of a nozzle orifice of a nozzle, the nozzle including a fluid chamber to hold fluid including particles having an electrical charge of a first polarity, the nozzle orifice extending from the top surface to the fluid chamber, the nozzle to eject individual fluid drops having an electrical charge of a known polarity from the fluid chamber at the nozzle orifice, the electrode being disposed concentrically about and set back from a perimeter of the nozzle orifice so as to not directly contact fluid ejected from the nozzle orifice:

providing an electric charge to the electrode to modify movement of electrically charged components of the fluid drop having the electrical charge of the known polarity, including, prior to initiating ejection of a fluid drop from the nozzle orifice:

applying a first electrical charge of the first polarity to a conductive element at a bottom of the fluid chamber; and applying to a second electrical charge of a second polarity opposite the first polarity to the electrode, the first electrical charge and second electrical charge together forming an electrical field across the fluid in the fluid chamber from the bottom of the fluid chamber to the top surface of the nozzle layer that moves the charged particles away from the bottom of the fluid chamber toward the top surface so as to more evenly distribute the particles throughout the fluid.

9. A method of operating a fluidic die comprising:

disposing an electrode on a top surface of a nozzle layer about a perimeter of a nozzle orifice of a nozzle, the nozzle including a fluid chamber to hold fluid, the nozzle orifice extending from the top surface to the fluid chamber, the nozzle to eject fluid drops from the fluid chamber via the nozzle orifice; and providing an electric charge to the electrode to modify movement of electrically charged components of the fluid, the fluid including different types of biologic particles, each type capable of accumulating differing levels of electric charge, the method including:

disposing a deflector plate electrically charged with a first polarity above the top surface of the nozzle layer along an ejection path from the nozzle orifice;

disposing the electrode concentrically about a perimeter of the nozzle orifice so as to directly contact fluid ejected from the nozzle orifice;

applying an electrical charge having the first polarity to the electrode as a fluid drop containing a biologic particle passes through the nozzle orifice;

ejecting the fluid drop containing the electrically charged biologic particle from the nozzle orifice along the ejection path; and deflecting the electrically charged biologic particle from the ejection path with a repulsive force between the deflector plate and electrically charged biologic particle, an angle of deflection from the trajectory path depending on a level of accumulated charge on the biologic particle.

* * * * *